US010417960B2

(12) United States Patent
Xiang et al.

(10) Patent No.: US 10,417,960 B2
(45) Date of Patent: Sep. 17, 2019

(54) ORGANIC ELECTROLUMINESCENT DISPLAY PANEL AND DISPLAY DEVICE

(71) Applicant: SHANGHAI TIANMA AM-OLED CO., LTD., Shanghai (CN)

(72) Inventors: Dongxu Xiang, Shanghai (CN); Yue Li, Shanghai (CN); Renyuan Zhu, Shanghai (CN); Yana Gao, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/865,082

(22) Filed: Jan. 8, 2018

(65) Prior Publication Data

US 2018/0130409 A1 May 10, 2018

(30) Foreign Application Priority Data

Jul. 10, 2017 (CN) ..... 2017 1 0557734

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0426* (2013.01); *G09G 2300/0814* (2013.01); *G09G 2300/0819* (2013.01); *G09G 2300/0842* (2013.01); *G09G 2300/0861* (2013.01); *G09G 2300/0866* (2013.01); *G09G 2310/08* (2013.01); *G09G 2320/0214* (2013.01); *G09G 2320/0219* (2013.01); *G09G 2320/045* (2013.01)

(58) Field of Classification Search
CPC ..... G09G 2310/08
See application file for complete search history.

(56) References Cited

U.S. PATENT DOCUMENTS

| | | | | |
|---|---|---|---|---|
| 2014/0320385 | A1* | 10/2014 | Kwon | G09G 3/3233 345/82 |
| 2016/0232849 | A1* | 8/2016 | Jeon | G09G 3/3233 |
| 2016/0321995 | A1 | 11/2016 | Shin | |
| 2017/0316739 | A1* | 11/2017 | Oh | G09G 3/3233 |
| 2017/0365647 | A1* | 12/2017 | Choi | G09G 3/3233 |
| 2018/0151123 | A1* | 5/2018 | Li | G09G 3/3233 |

FOREIGN PATENT DOCUMENTS

| | | | |
|---|---|---|---|
| CN | 1605092 | A | 4/2005 |
| CN | 101447169 | A | 6/2009 |
| CN | 103199096 | A | 7/2013 |

(Continued)

*Primary Examiner* — Priyank J Shah
(74) *Attorney, Agent, or Firm* — Alston & Bird LLP

(57) ABSTRACT

The disclosure discloses an organic electroluminescent display panel and a display panel, where initialization transistor and the control transistor are connected by a second power source signal line, and if the initialization transistor is turned on by first scan signal line, and if the control transistor is turned on by light emitting control line, then different electrical signal will be loaded on the second power source signal line to thereby reset the gate of a drive transistor in an initialization stage, and to load power source voltage to the source of the drive transistor for light emission and displaying, in a light emitting stage.

13 Claims, 16 Drawing Sheets

(56) References Cited

FOREIGN PATENT DOCUMENTS

| | | | |
|---|---|---|---|
| CN | 104217675 | A | 12/2014 |
| CN | 105161049 | A | 12/2015 |
| CN | 105869573 | A | 8/2016 |
| CN | 106128360 | A | 11/2016 |
| CN | 106531067 | A | 3/2017 |
| KR | 20140062369 | A | 5/2014 |

* cited by examiner

ORGANIC ELECTROLUMINESCENT DISPLAY PANEL AND DISPLAY DEVICE

This application claims the benefit of Chinese Patent Application No. CN 201710557734.3, filed with the Chinese Patent Office on Jul. 10, 2017, which is hereby incorporated by reference in its entirety.

FIELD

The present disclosure relates to the field of display technologies, and particularly to an organic electroluminescent display panel and a display device.

BACKGROUND

An Organic Light-Emitting Diode (OLED) display panel is one of focuses in the field of display panels at present, and as compared with a Liquid Crystal Display (LCD), the OLED display panel has low power consumption, a low production cost, self-light-emission, a wide angle of view, a high response speed, and other advantages. At present, the OLED display panel has come to take the place of the traditional LCD display panel in the field of mobile phone displays.

Unlike the LCD in which brightness is controlled using stable voltage, the OLED display which is current-driven, needs to be controlled using stable current to emit light. Typically the OLED display is driven by a drive transistor in a pixel driver circuit in the OLED display, where while the drive transistor is operating, there is some defect in the drive transistor, and the drive transistor keeps on operating nearly all the time, so the source of the drive transistor may be biased at the same voltage for a long period of time, and thus the threshold voltage thereof may drift, and the mobility thereof may vary by an increasing factor, thus making the characteristic of the drive transistor drift, which may result in a display abnormality, and thus degrade the stability of the display.

Accordingly in the OLED display panel, typically a pixel circuit in which the threshold voltage $V_{th}$ of the drive transistor is compensated for is used to drive the OLED to emit light. In order to compensate for the threshold voltage, the pixel circuit is typically 7T1C-structured (including seven switch transistors and one capacitor) as illustrated in the circuit structure of FIG. 1A, and the corresponding timing diagram of FIG. 1B, where two reset signal lines are needed to provide voltage signals loaded on an initialized signal terminal VINT and a reference signal terminal VREF. Since the Pixels Per Inch (PPI) of the display has been improved to 600+ at present, the limit of the array process for the sophisticated pixel circuit has been challenged. Particularly in a Virtual Reality (VR) display, or another product for which a high PPI (typically higher than that required for a Quarter High Definition (QHD) display) is required, signal lines in the existing OLED display panel are so complicated that it may hinder the high PPI from being achieved.

SUMMARY

Embodiments of the disclosure provide an organic electroluminescent display panel and a display device so as to address the problem of complicated signal lines in the prior art.

An embodiment of the disclosure provides an organic electroluminescent display panel, where the organic electroluminescent display panel includes:

a first scan signal line, second scan signal lines, light emitting control line, and a first power source signal line, which are arranged in parallel;

a data signal line and a second power source signal line, which are arranged in parallel and across the first scan signal line, the second scan signal line, the light emitting control line, and the first power source signal line;

a switch transistor with a gate connected with the second scan signal line, and a source connected with the data signal line;

a drive transistor with a source connected with a drain of the switch transistor;

an organic light emitting diode connected with a drain of the drive transistor;

an initialization transistor with a gate connected with the first scan signal line, a source connected with the second power source signal line, and a drain connected with a gate of the drive transistor;

a control transistor with a gate connected with the light emitting control line, a source connected with the second power source signal line, and a drain connected with the source of the drive transistor; and a storage capacitor with first terminal connected with the first power source signal line, and a second terminal connected with the gate of the drive transistor;

wherein in a period of time of one frame, the second power source signal line are loaded with different electrical signals when the initialization transistor and the control transistor are turned on.

An embodiment of the disclosure provides a display device including the organic electroluminescent display panel above according to the embodiment of the disclosure.

Advantageous effects of the embodiments of the disclosure are as follows.

In the organic electroluminescent display panel and the display device above according to the embodiments of the disclosure, the initialization transistor and the control transistor are connected by the second power source signal line, and if the initialization transistor is turned on by the first scan signal line, and if the control transistor is turned on by the light emitting control line, then different electrical signals will be loaded on the second power source signal line to reset the gate of the drive transistor in the initialization stage when the initialization transistor is turned on, and to load the power source voltage to the source of the drive transistor for light emitting and displaying, in the light emitting stage when the control transistor is turned on, so that the existing two reset signal lines can be dispensed with to thereby simplify a complicated circuit arrangement pattern in the organic electroluminescent display panel so as to facilitate displaying at a high resolution. Furthermore the second power source signal line is arranged parallel to the data signal line, so that a line arrangement space perpendicular to the data signal line can be spared to arrange therein the first power source signal line across the second power source signal line and the data signal line, and the first terminal of the storage capacitor to thereby facilitate a compact circuit arrangement pattern design so as to facilitate displaying at a high resolution, thus facilitating a high PPI required for a virtual reality display.

DETAILED DESCRIPTION OF THE EMBODIMENTS

Figure 1A:
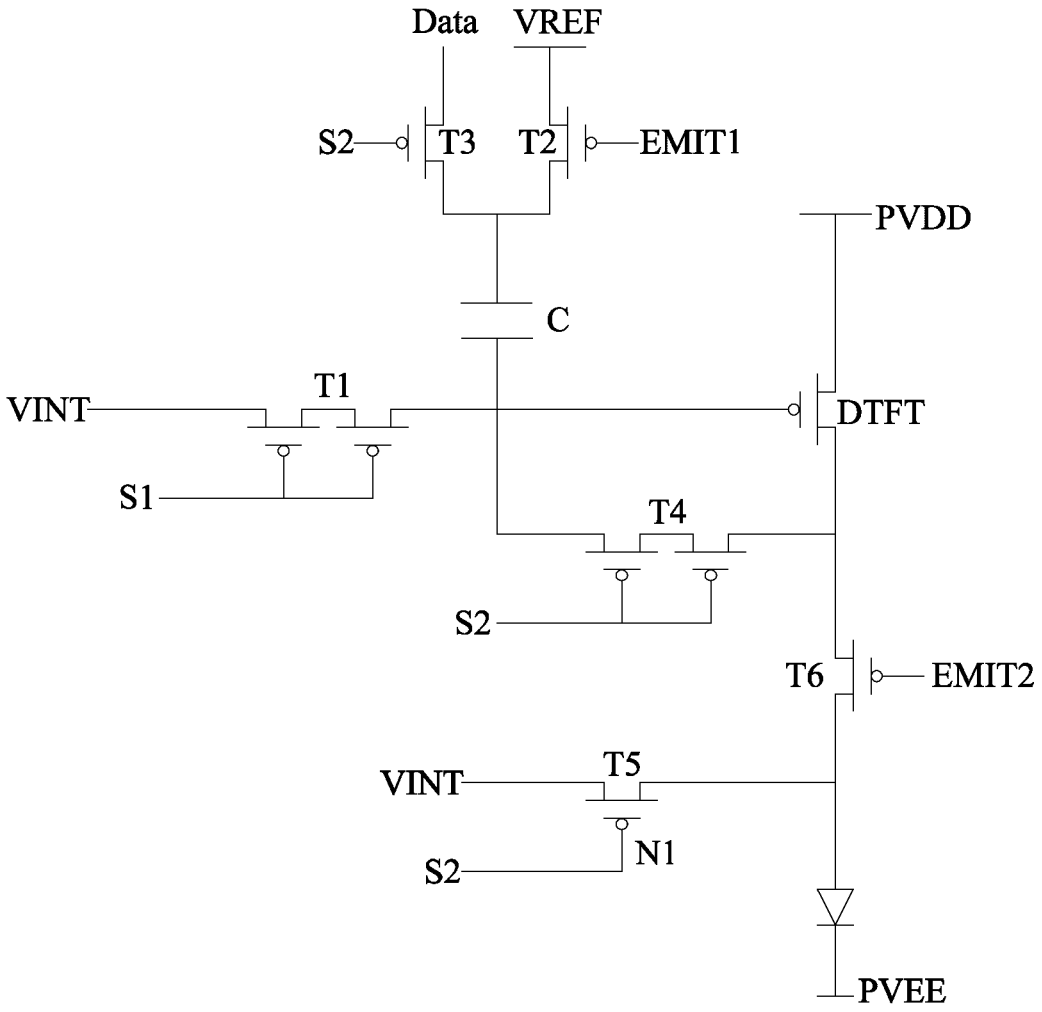
FIG. 1A is a schematic circuit diagram of a pixel circuit in the prior art.
Figure 1B:
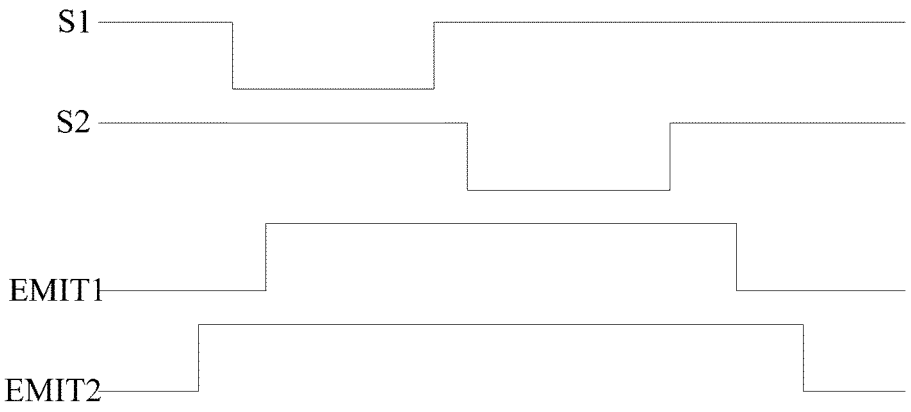
FIG. 1B is a timing diagram corresponding to the circuit illustrated in FIG. 1A.

In order to make the objects, technical solutions, and advantages of the disclosure more apparent, specific implementations of the organic electroluminescent display panel and the display panel according to the embodiments of the disclosure will be described below in details with reference to the drawing. It shall be appreciated that the preferred embodiments to be described below are merely intended to illustrate and explain the disclosure, but not to limit the disclosure. The embodiments of the disclosure, and the features in the embodiments can be combined with each other unless they conflict with each other.

Figure 2A:
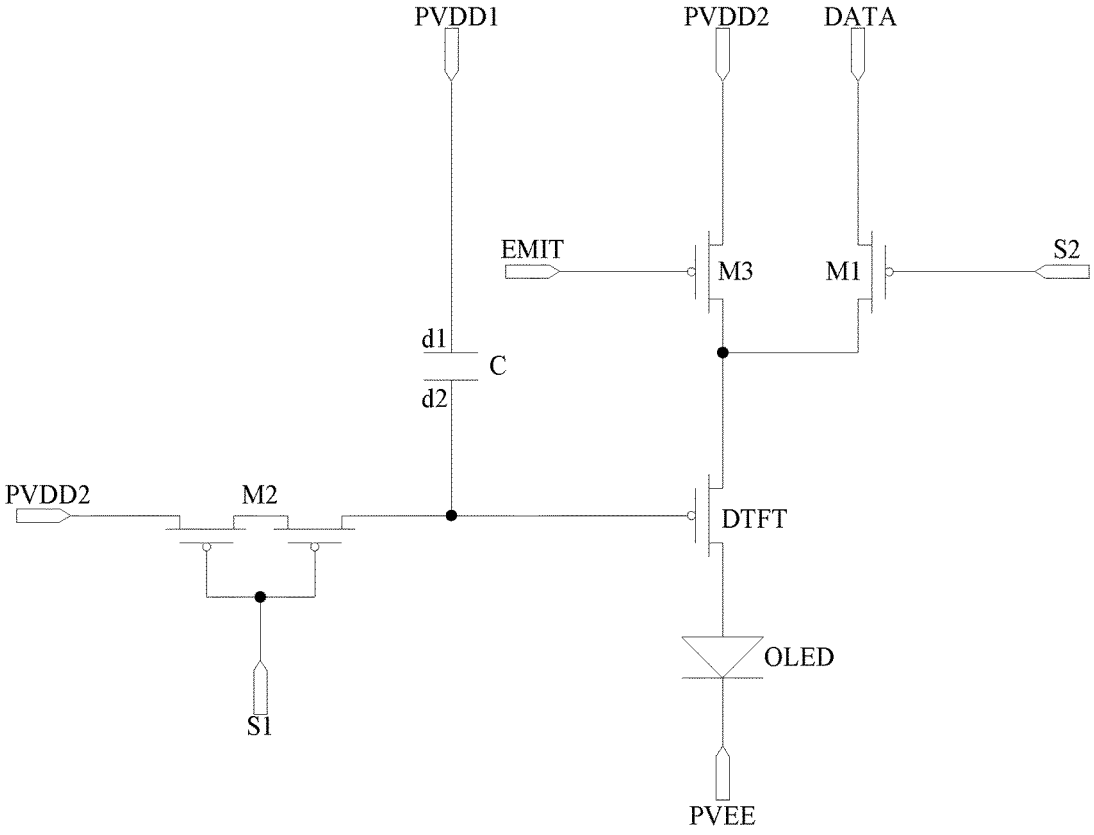
FIG. 2A is a first schematic circuit diagram of an organic electroluminescent display panel according to an embodiment of the disclosure.
Figure 2B:
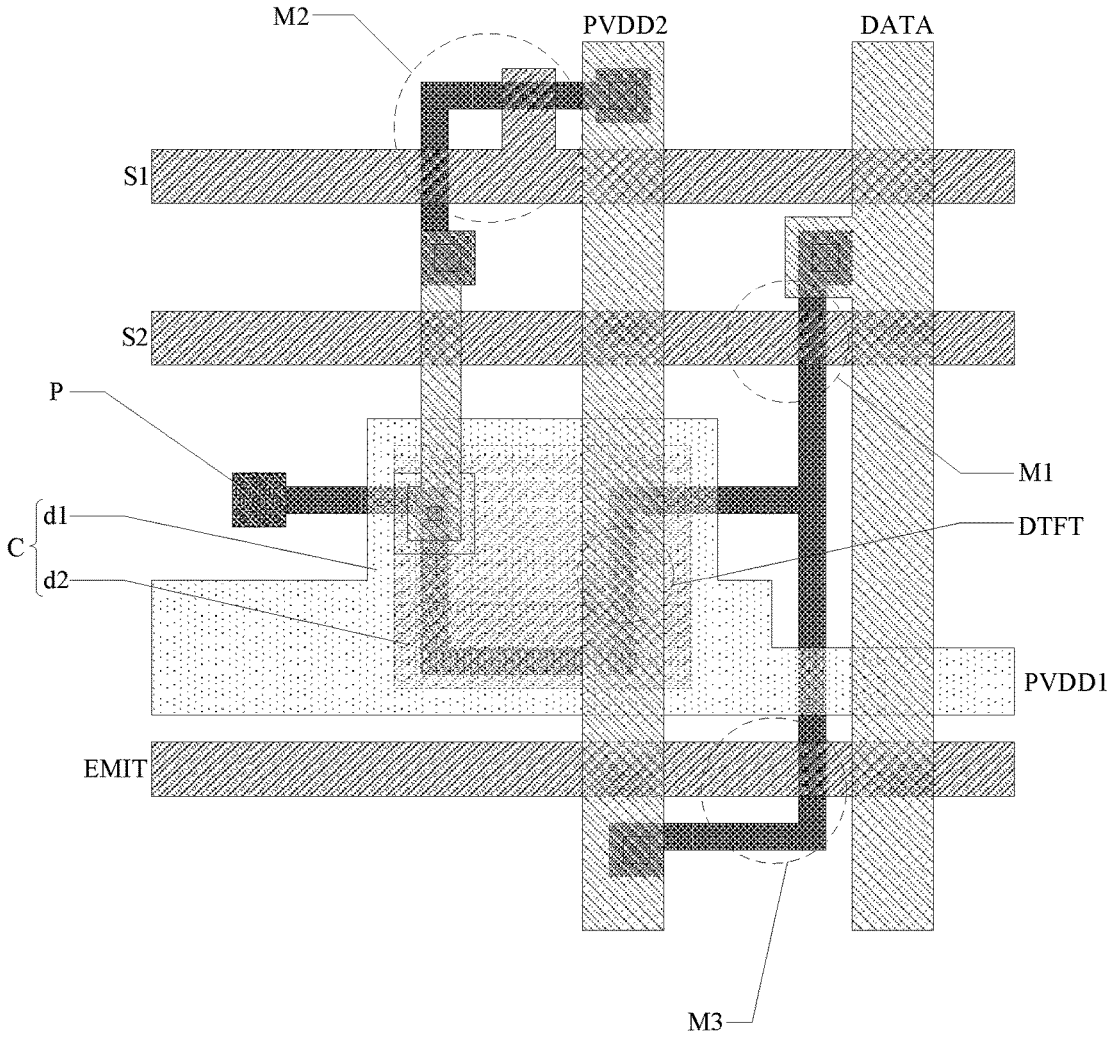
FIG. 2B is a schematic structural diagram corresponding to the circuit illustrated in FIG. 2A.

In a specific implementation, an embodiment of the disclosure provides an organic electroluminescent display panel as illustrated in the schematic circuit diagram of FIG. 2A, and the schematic structural diagram of FIG. 2B, where the organic electroluminescent display panel includes: a first scan signal lines S1, a second scan signal lines S2, a light emitting control line EMIT, and a first power source signal line PVDD1, all of which are arranged in parallel; a data signal line DATA and a second power source signal line PVDD2, which are arranged in parallel and across the first scan signal line S1, the second scan signal line S2, the light emitting control line EMIT, and the first power source signal line PVDD1; a switch transistor M1 with a gate connected with the second scan signal line S2, and a source connected with the data signal line DATA; a drive transistor DTFT with a source connected with a drain of the switch transistor M1; an Organic Light Emitting Diode (OLED) connected with a drain of the drive transistor DTFT; an initialization transistor M2 with a gate connected with the first scan signal line S1, a source connected with the second power source signal line PVDD2, and a drain connected with a gate of the drive transistor DTFT; a control transistor M3 with a gate connected with the light emitting control line EMIT, a source connected with the second power source signal line PVDD2, and a drain connected with the source of the drive transistor DTFT; and a storage capacitors C2 with a first terminal d1 connected with the first power source signal line PVDD1, and a second terminal d2 connected with the gate of the drive transistor DTFT.

Where in a period of time of one frame, the second power source signal line are loaded with different electrical signals when the initialization transistor and the control transistor are turned on.

It shall be noted that those skilled in the art can appreciate that the signal lines "arranged in parallel" to each other as referred to in the organic electroluminescent display panel above according to the embodiment of the disclosure may not be arranged perfectly in parallel, but the signal lines are arranged substantially parallel to each other instead of intersecting with each other.

Specifically in the organic electroluminescent display panel above according to the embodiment of the disclosure, since the initialization transistor M2 and the control transistor M3 are connected by the second power source signal line PVDD2 instead of a reset signal line so that the existing two reset signal lines can be dispensed to thereby simplify a complicated circuit arrangement pattern in the organic electroluminescent display panel so as to facilitate displaying at a high resolution. Furthermore, the second power source signal line PVDD2 is arranged parallel to the data signal line DATA, where the second power source signal line PVDD2 and the data signal line DATA are typically lines arranged in the longitudinal direction as illustrated in FIG. 2B, so that a line arrangement space perpendicular to the data signal line DATA can be spared to arrange therein the first power source signal line PVDD1 across the second power source signal line PVDD2 and the data signal line DATA, and the first terminal d1 of the storage capacitor C, that is, the first power source signal line PVDD1, the first scan signal line S1, the second scan signal line S2, and the light emitting control line EMIT are typically lines arranged in the transverse direction as illustrated in FIG. 2B to thereby facilitate a compact circuit arrangement pattern design so as to facilitate displaying at a high resolution, thus facilitating a high PPI required for a virtual reality display.

Specifically in the organic electroluminescent display panel above according to the embodiment of the disclosure, if the initialization transistor M2 is turned on by the first scan signal line S1, and if the control transistor M3 is turned on by the light emitting control line EMIT, then different electrical signals will be loaded on the second power source signal line PVDD2 to initialize and reset the gate of the drive transistor DTFT in an initialization stage when the initialization transistor M2 is turned on (where the control transistor M3 is turned off), and to load power source voltage to the source of the drive transistor DTFT for light emitting and displaying, in a light emitting stage when the control transistor M3 is turned on (where the initialization transistor M2 is turned off).

In a specific implementation, in the organic electroluminescent display panel above according to the embodiment of the disclosure, as illustrated in the schematic circuit diagram of FIG. 2A, and the corresponding schematic structural diagram of FIG. 2B, the initialization transistor M2 can be arranged in a dual-gate structure to thereby alleviate leakage current when the initialization transistor M2 is turned off, so as to alleviate interference of the leakage current of the initialization transistor M2 to the drive transistor DTFT in the light emitting stage, which would otherwise affect driving current in the drive transistor DTFT.

Figure 3A:
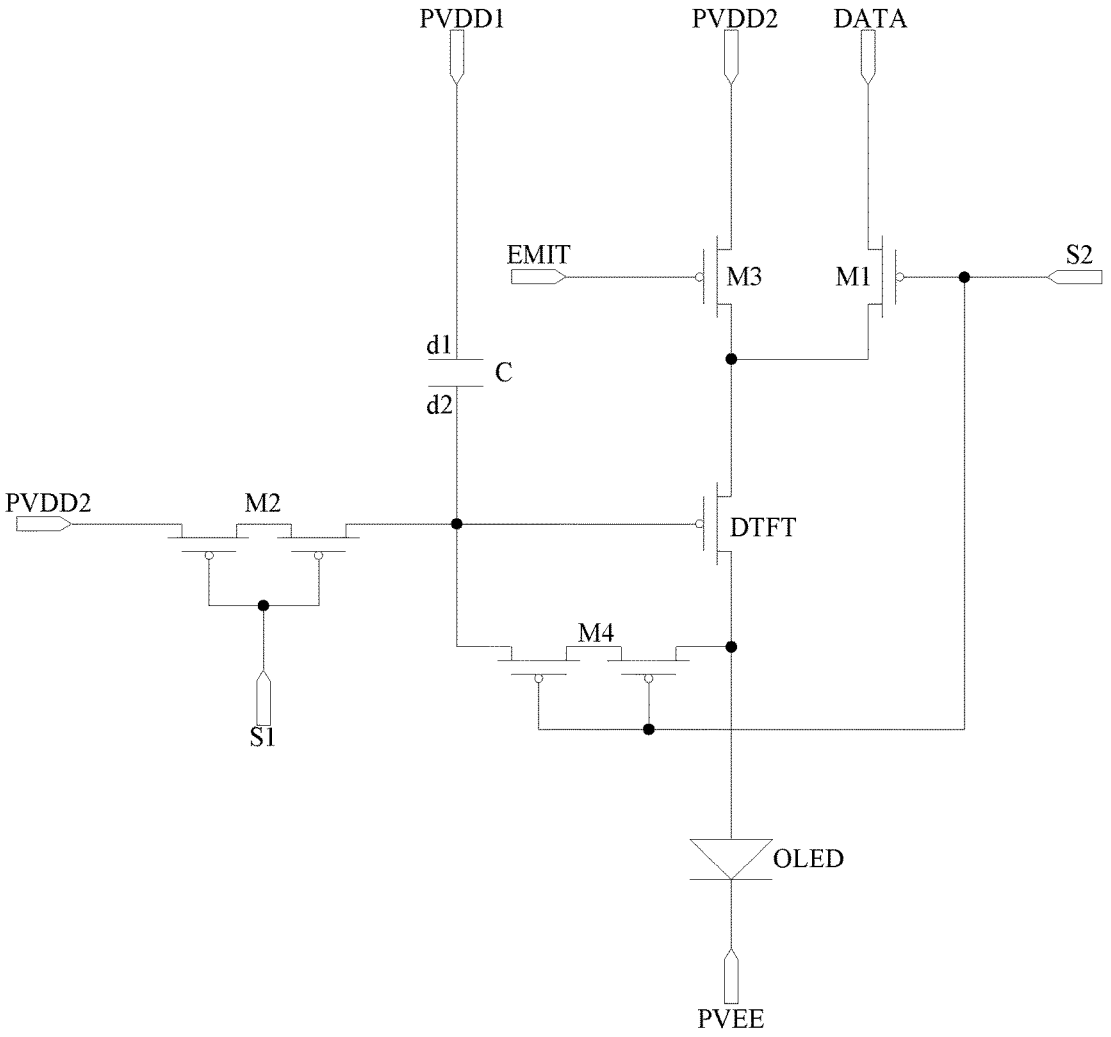
FIG. 3A is a second schematic circuit diagram of an organic electroluminescent display panel according to an embodiment of the disclosure.
Figure 3B:
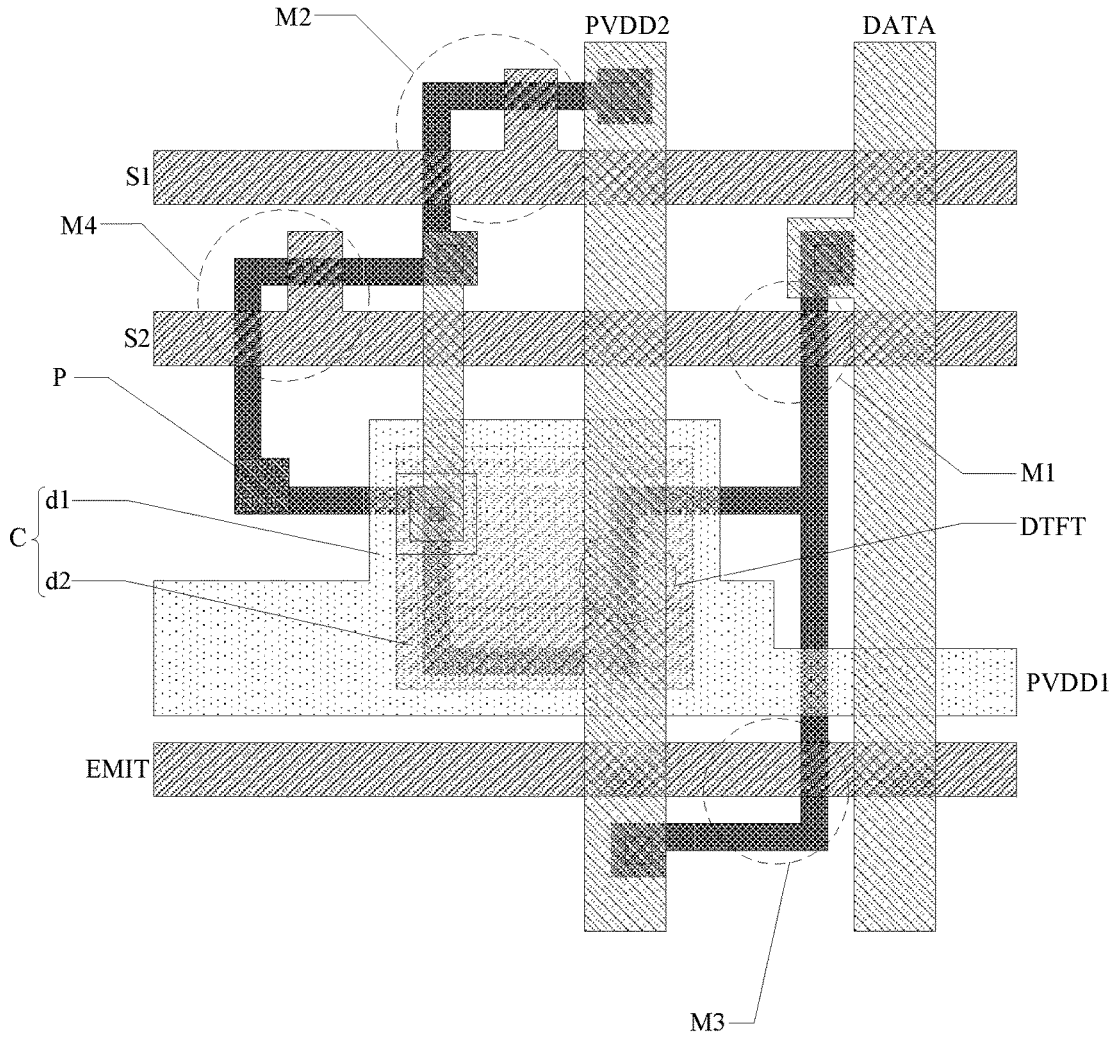
FIG. 3B is a schematic structural diagram corresponding to the circuit illustrated in FIG. 3A.

In a specific implementation, in the organic electroluminescent display panel above according to the embodiment of the disclosure, as illustrated in the schematic circuit diagram of FIG. 3A, and the corresponding schematic structural diagram of FIG. 3B, the organic electroluminescent display panel can further include a compensation transistor M4 with a gate connected with the second scan signal line S2, a source connected with the gate of the drive transistor DTFT, and a drain connected with the drain of the drive transistor DTFT. Specifically if the compensation transistor M4 is controlled by the second scan signal line S2 to be turned on, then the drain and gate of the drive transistor DTFT will be turned on, that is, if the switch transistor M1 is turned on by the second scan signal line S2, then the compensation transistor M4 will also be turned on, and data signal loaded on the data signal line DATA will be loaded to the source of the drive transistor DTFT through the switch transistor M1 which is turned on, where the voltage at the source and the gate of the drive transistor DTFT is Vdata−|Vth|, that is, the gate of the drive transistor DTFT can be compensated for by the threshold voltage thereof in a data writing stage to thereby eliminate an influence of |Vth| in the driving current to be input from the drive transistor DTFT to the organic light emitting diode OLED in a light emitting stage, that is, to eliminate an influence of drifting of the threshold voltage of the drive transistor on light emission, so that there is a threshold voltage compensation function in the organic electroluminescent display panel.

In a specific implementation, in the organic electroluminescent display panel above according to the embodiment of the disclosure, as illustrated in the schematic circuit diagram of FIG. 3A, and the corresponding schematic structural diagram of FIG. 3B, the compensation transistor M4 is structured with dual gate, so that leakage current in the compensation transistor M4 which is turned off to alleviate interference of the leakage current of the compensation transistor M4 to the drive transistor DTFT in the light emitting stage, which would otherwise affect the driving current in the drive transistor DTFT.

Figure 4A:
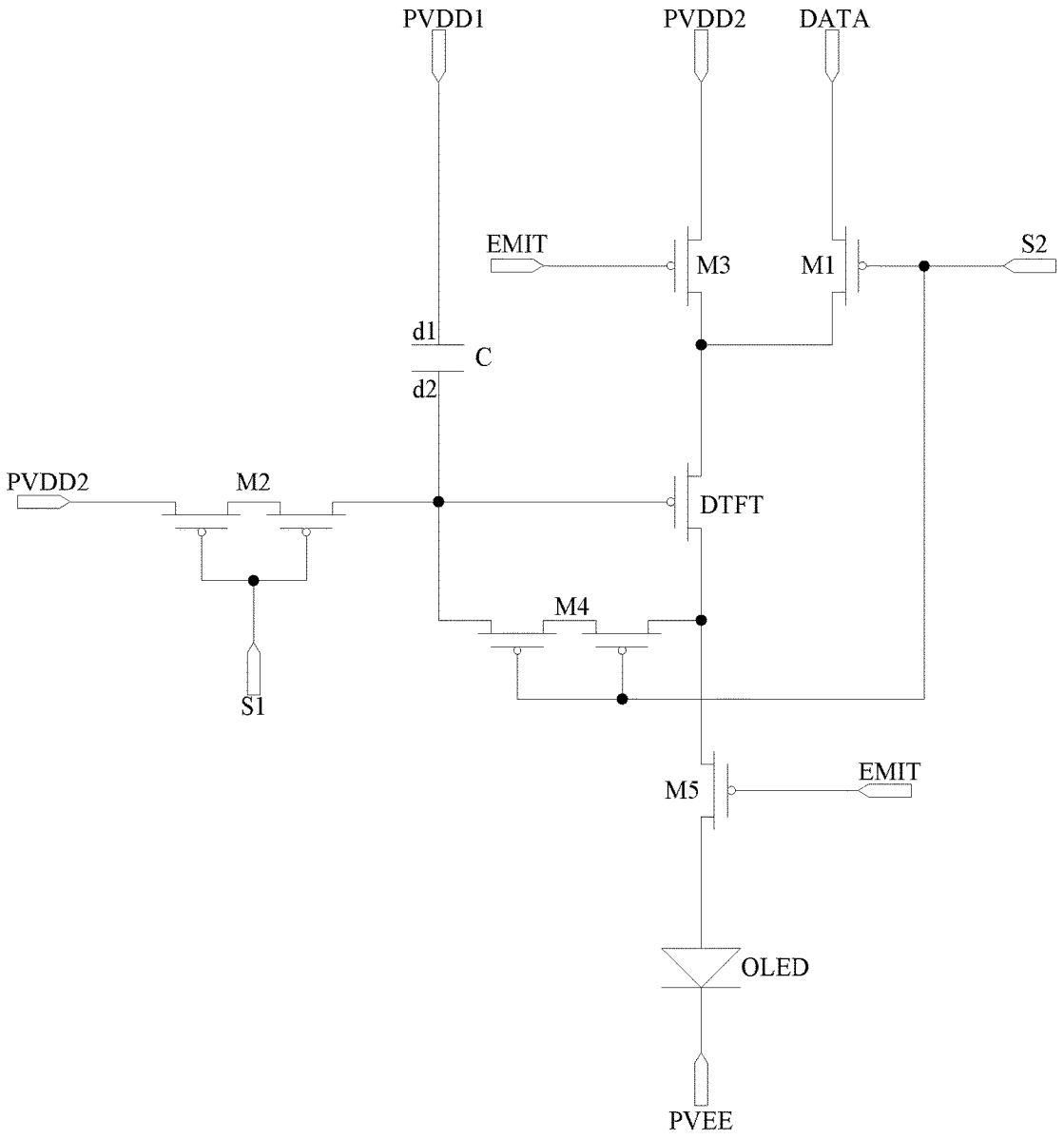
FIG. 4A is a third schematic circuit diagram of an organic electroluminescent display panel according to an embodiment of the disclosure.
Figure 4B:
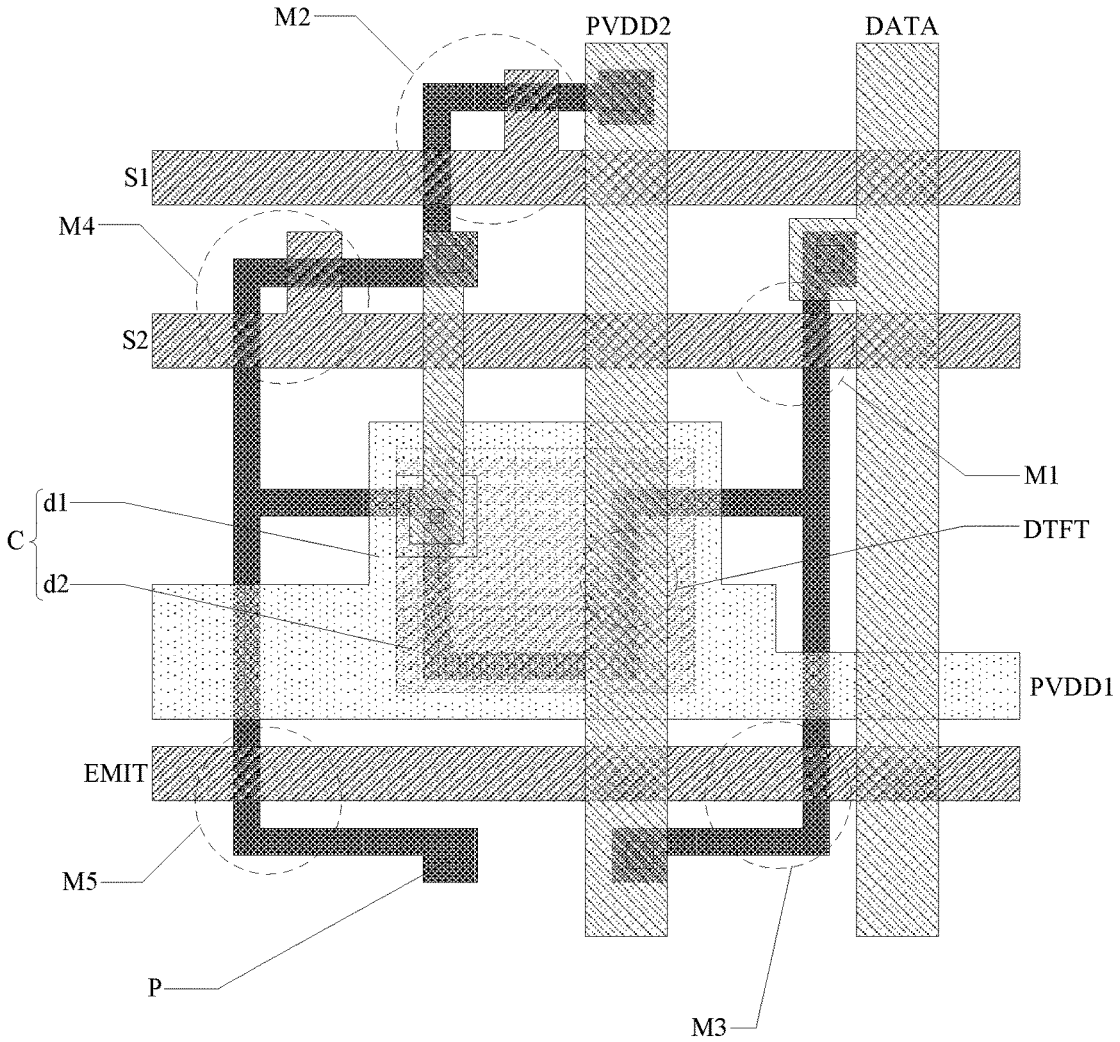
FIG. 4B is a schematic structural diagram corresponding to the circuit illustrated in FIG. 4A.

In a specific implementation, in the organic electroluminescent display panel above according to the embodiment of the disclosure, as illustrated in the schematic circuit diagram of FIG. 4A, and the corresponding schematic structural diagram of FIG. 4B, the organic electroluminescent display panel can further include a light emitting control transistor M5 with a gate connected with the light emitting control line EMIT, a source connected with the drain of the drive transistor DTFT, and a drain connected with the organic light emitting diode OLED. Specifically if the light emitting control transistor M5 is controlled by the light emitting control line EMIT to be turned on, then the drain of the drive transistor DTFT will be connected with the organic light emitting diode OLED, that is, the light emitting control transistor M5 can be turned off in both the initialization stage and the data writing stage to thereby avoid driving current from being generated to drive light emission in these two stages.

Figure 5A:
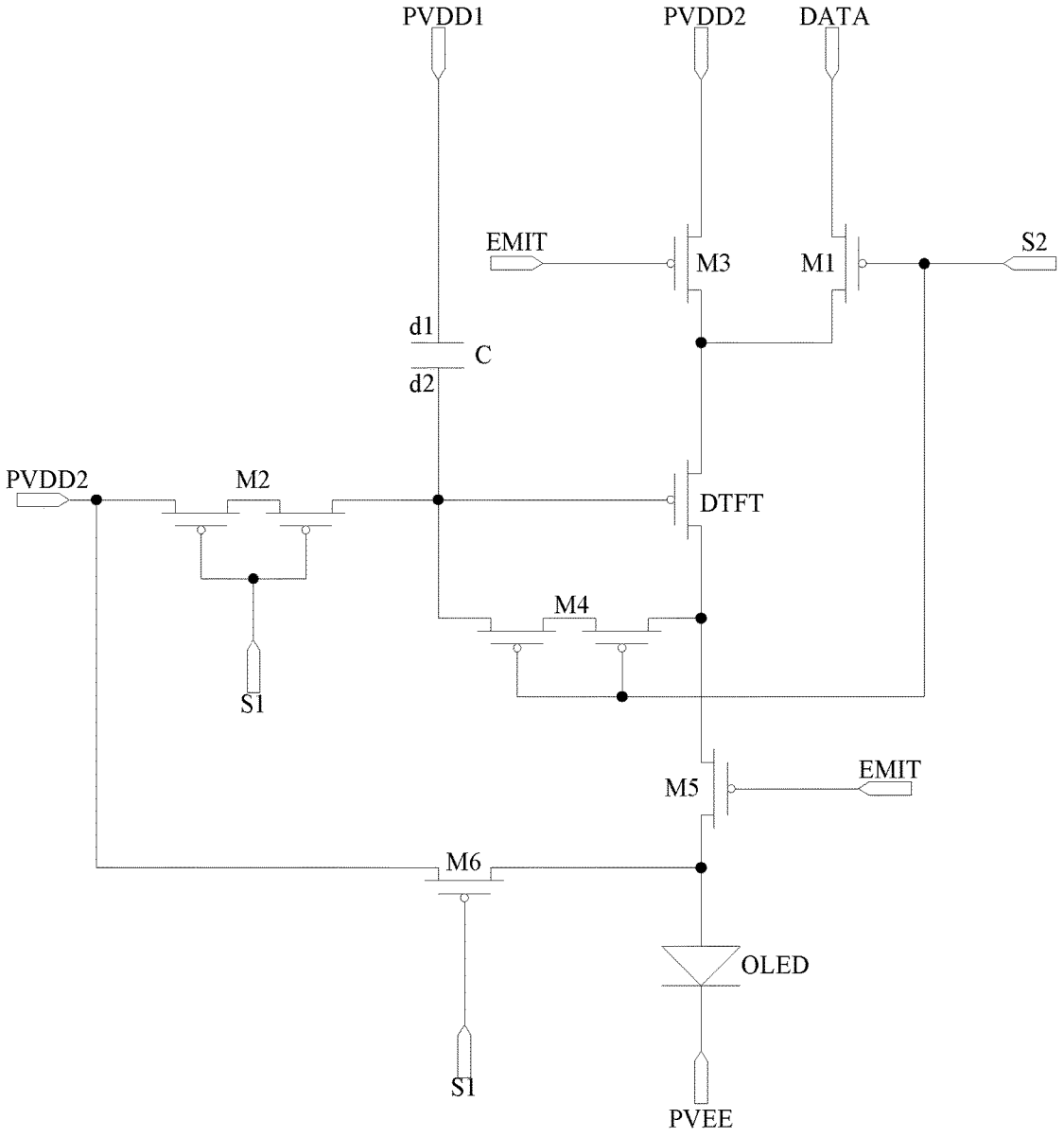
FIG. 5A is a fourth schematic circuit diagram of an organic electroluminescent display panel according to an embodiment of the disclosure.
Figure 5B:
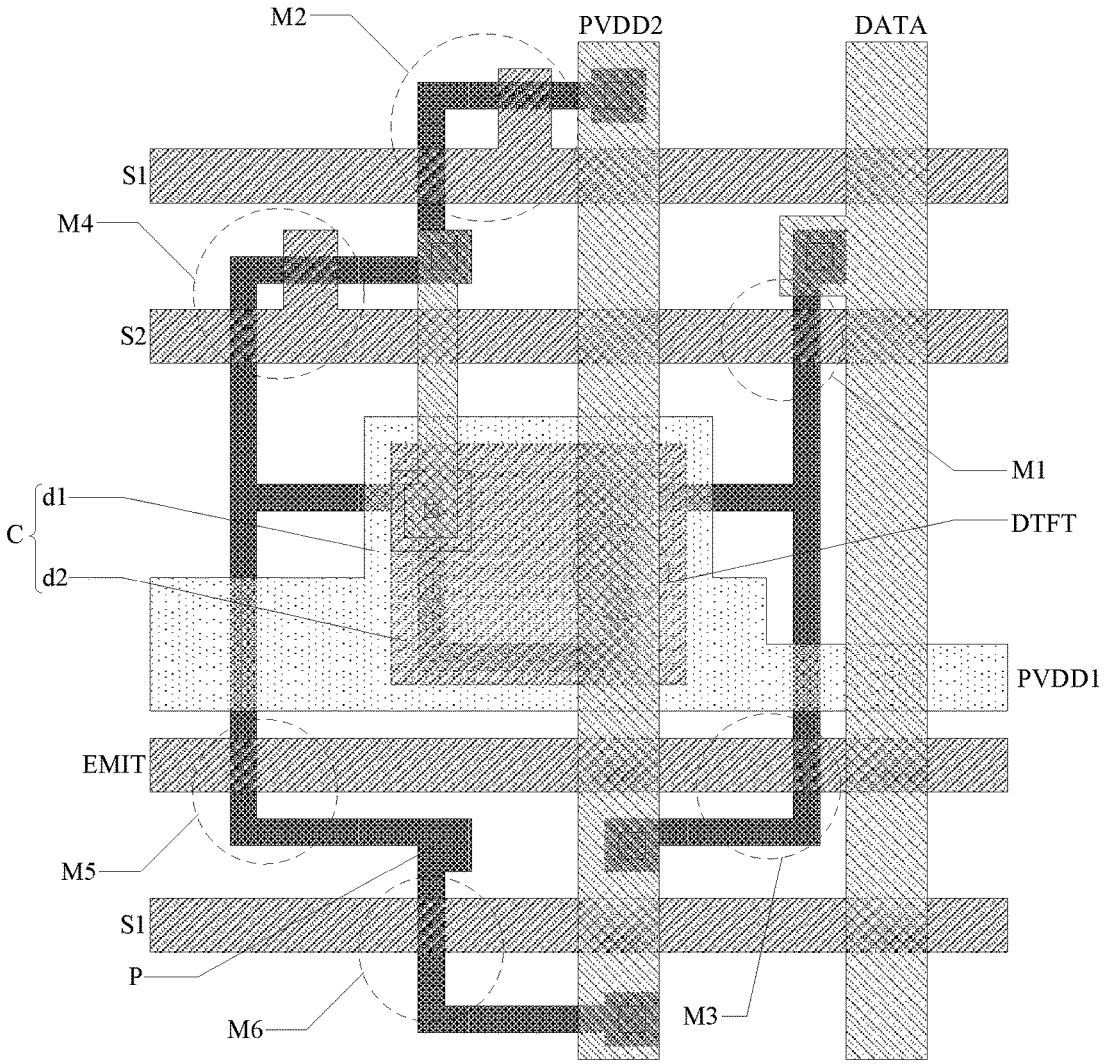
FIG. 5B is a first schematic structural diagram corresponding to the circuit illustrated in FIG. 5A.

In a specific implementation, in the organic electroluminescent display panel above according to the embodiment of the disclosure, as illustrated in the schematic circuit diagram of FIG. 5A, and the corresponding schematic structural diagram of FIG. 5B, the organic electroluminescent display panel can further include an anode reset transistor M6 with a gate connected with the first scan signal line S1, a source connected with the second power source signal line PVDD2, and a drain connected with the organic light emitting diode OLED. Specifically if the anode reset transistor M6 is controlled by the first scan signal line S1 to be turned on, then the organic light emitting diode OLED will be connected with the second power source signal line PVDD2, that is, if the initialization transistor M2 is turned on by the first scan signal line S1, then the anode reset transistor M6 will also be turned on, and the gate of the drive transistor DTFT, and the organic light emitting diode OLED respectively will be initialized and reset by the voltage on the second power source signal line PVDD2 at this time through the initialization transistor M2 and the anode reset transistor M6. Hereupon the voltage loaded on the second power source signal line PVDD2 at this time shall be different from the power source voltage loaded in the light emitting stage, and in order to avoid the organic light emitting diode OLED from being driven to emit light at this time, the voltage loaded on the second power source signal line PVDD2 at this time shall be the same as that at the other terminal of the organic light emitting diode OLED, that is, generally the PVEE is also a low level.

In a specific implementation, in the organic electroluminescent display panel above according to the embodiment of the disclosure, the first power source signal line PVDD1 and the second power source signal line PVDD2 are the same type of signal line, that is, although they are connected with different transistors, and arranged in different directions, generally the same electrical signal is loaded on them, and in order to stabilize the power source voltage loaded on the power source signal lines, generally they are electrically connected to thereby reduce a contact resistance of and a signal delay on the power source signal lines. Hereupon as illustrated in the schematic circuit diagram of FIG. 5A, and the corresponding structural diagram of FIG. 6, since the first power source signal line PVDD1 and the second power source signal line PVDD2 are arranged in different directions, generally they are arranged at different metal layers, and in order to enable them to be electrically connected, the first power source signal line PVDD1 and the second power source signal line PVDD2 need to be connected through connection holes A.

In a specific implementation, in the organic electroluminescent display panel above according to the embodiment of the disclosure, the connection holes A need to be arranged in an area where the first power source signal line PVDD1 overlaps with the second power source signal line PVDD2, and the larger the aperture of the connection holes A is, the better to reduce the contact resistance between them. In the organic electroluminescent display panel above according to the embodiment of the disclosure, the storage capacitor C consisted of two electrode terminals overlapping with each other by a preset area. Hereupon as illustrated in the schematic circuit diagram of FIG. 5A, and the corresponding structural diagram of FIG. 6, the connection holes A can be arranged in the area where the storage capacitor C is located, that is, the connection hole A can be arranged in each pixel circuit to thereby reduce a contact resistance as many as possible.

Figure 6:
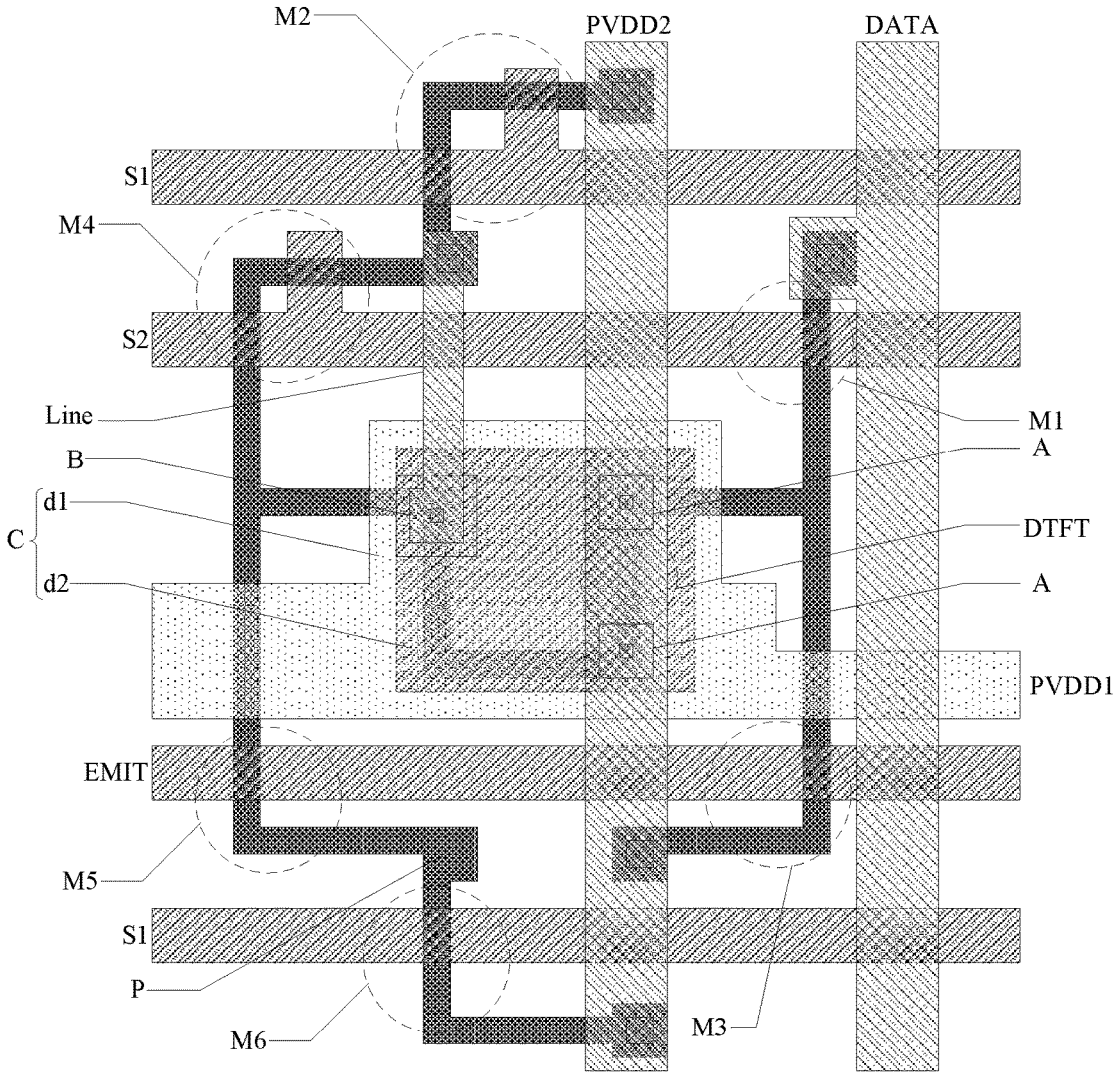
FIG. 6 is a second schematic structural diagram corresponding to the circuit illustrated in FIG. 5A.

In a specific implementation, in the organic electroluminescent display panel above according to the embodiment of the disclosure, a plurality of connection holes A can be further arranged to thereby reduce a contact resistance, and for example, as illustrated in the schematic circuit diagram of FIG. 5A, and the corresponding structural diagram of FIG. 6, preferably there may be two connection holes A.

In a specific implementation, in the organic electroluminescent display panel above according to the embodiment of the disclosure, as illustrated in FIG. 2B, FIG. 3B, FIG. 4B, FIG. 5B, and FIG. 6, the first scan signal line S1, the second scan signal line S2, the light emitting control line EMIT, and the second terminal d2 of the storage capacitor C do not overlap with each other, so they can be arranged at the same first metal layer; the first power source signal line PVDD1 is connected with the first terminal d1 of the storage capacitor C, so they can be arranged at a second metal layer; the data signal line DATA is parallel to the second power source signal line PVDD2, so they can be arranged at a third metal layer; and in order to enable the components at the respective metal layers to be connected as needed, the first metal layer, the second metal layer, and the third metal layer need to be stacked on each other in that order, where corresponding insulation layers are arranged between them, and punched in those areas where the components need to be connected. It shall be noted that in FIG. 2B, FIG. 3B, FIG. 4B, FIG. 5B, and FIG. 6, the same filling pattern is applied to the components at the respective film layers, and different filling patterns are applied to the different film layers to distinguish them from each other.

In a specific implementation, in the organic electroluminescent display panel above according to the embodiment of the disclosure, as illustrated in FIG. 2B, FIG. 3B, FIG. 4B, FIG. 5B, and FIG. 6, the source, the drain, and the channel areas of the respective transistors are arranged in a semiconductor layer, and corresponding doping processes are performed on the source and the drain, where the semiconductor layer is typically low-temperature poly-silicon, and the semiconductor layer is typically located below the first metal layer as needed for the process thereof.

In a specific implementation, in the organic electroluminescent display panel above according to the embodiment of the disclosure, the organic light emitting diode OLED is not illustrated in any one of the schematic structural diagrams illustrated in FIG. 2B, FIG. 3B, FIG. 4B, FIG. 5B, and FIG. 6, but a component P connected with the anode of the organic light emitting diode OLED is illustrated.

Figure 7A:
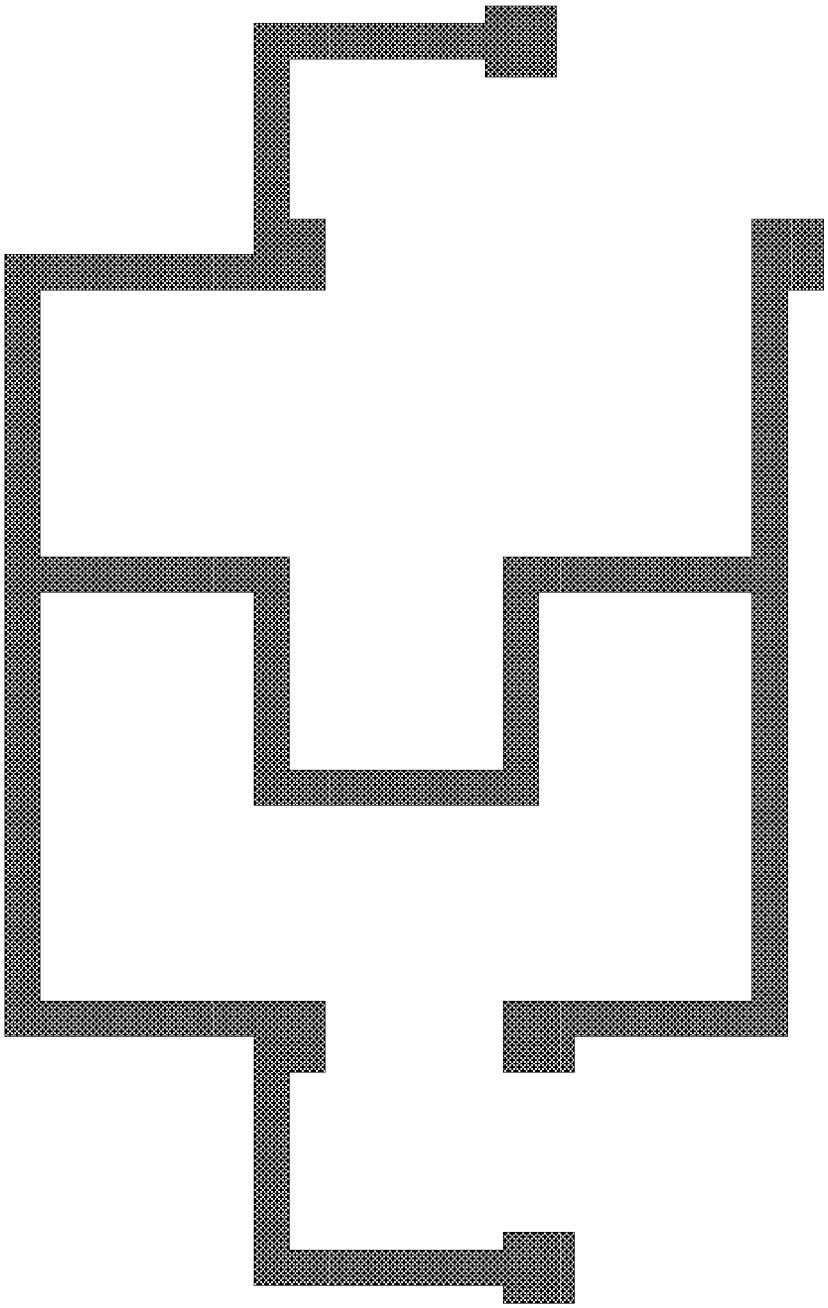
FIG. 7A to FIG. 7D are schematic diagrams after respective film layers corresponding to the structure illustrated in FIG. 6 are fabricated respectively.
Figure 7B:
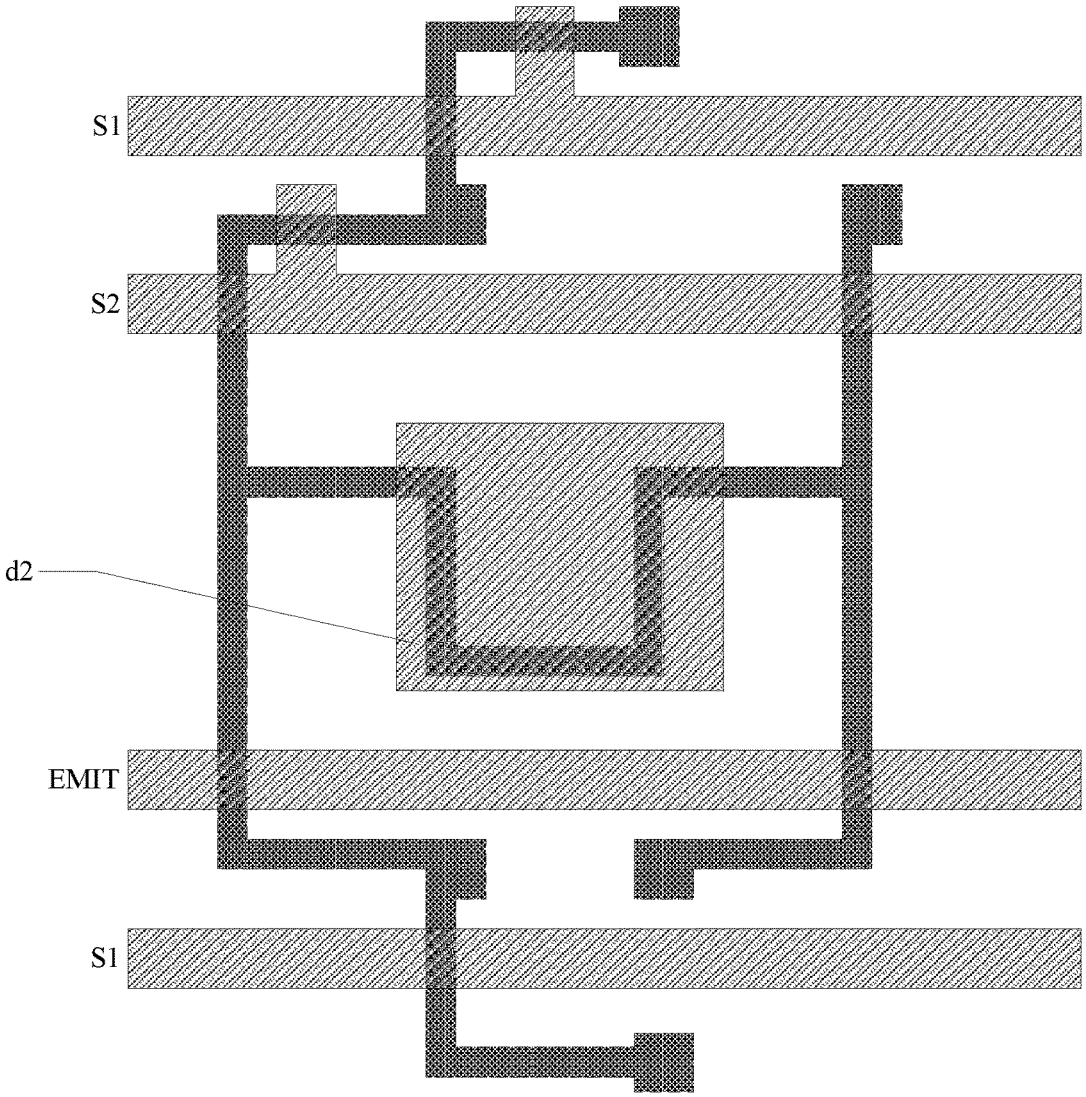
Figure 7C:
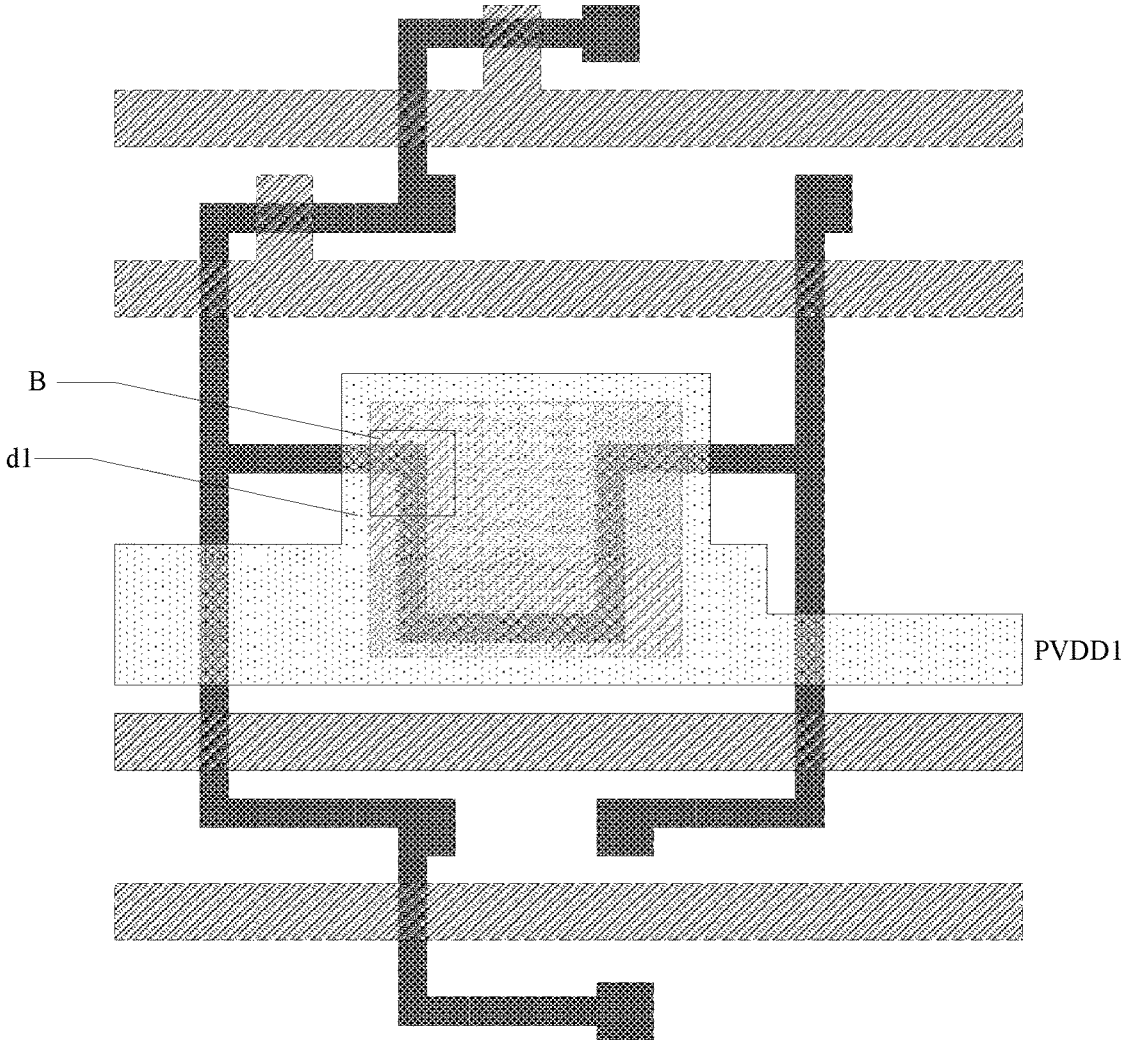
Figure 7D:
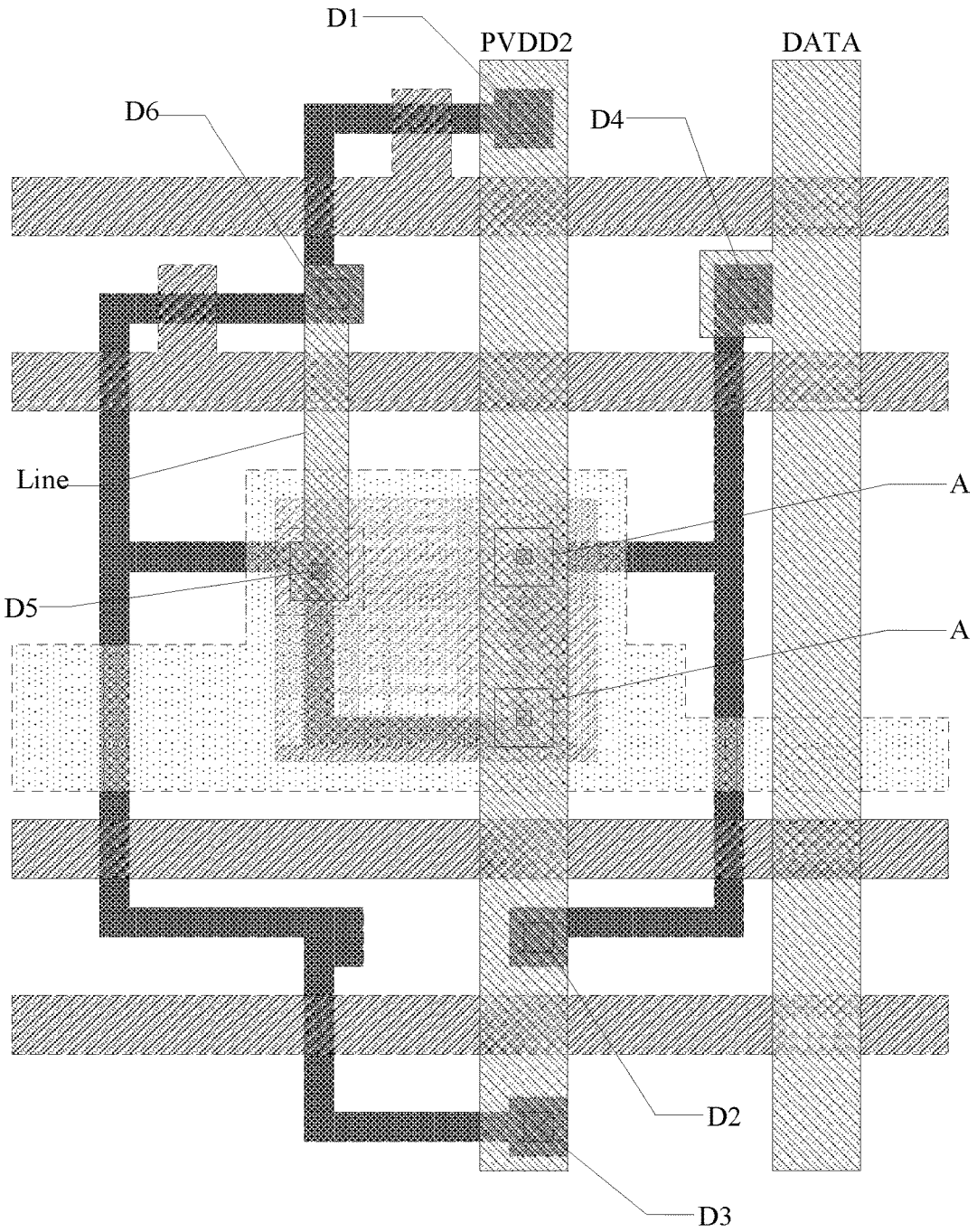

In a specific implementation, in the organic electroluminescent display panel above according to the embodiment of the disclosure, taking the structure illustrated in FIG. 6 as an example, it needs to be fabricated by firstly fabricating the semiconductor layer as illustrated in FIG. 7A, where the semiconductor layer includes the channel areas of the respective transistors. After a gate insulation layer is fabricated on the semiconductor layer, as illustrated in FIG. 7B, the first metal layer including the first scan signal line S1, the second scan signal line S2, the light emitting control line EMIT, and the second terminal d2 of the storage capacitor C2 is fabricated, where the gates of the respective transistors are formed in the areas where the first metal layer overlap with the semiconductor layer. After a first interlayer media layer is fabricated on the first metal layer, as illustrated in FIG. 7C, the second metal layer including the first power source signal line PVDD1, and the first terminal d1 of the storage capacitor C connected therewith is fabricated, where the storage capacitor C is defined in the area where the first terminal d1 overlap with the second terminal d2, and a through-hole B exposing the second terminal d2 of the storage capacitor C is defined in the pattern of the first terminal d1 of the storage capacitor C. After a second interlayer media layer is fabricated on the second metal layer, as illustrated in FIG. 7D, the third metal layer including the data signal line DATA, the second power source signal line PVDD2, and connection line LINE is fabricated, where the second power source signal line PVDD2 is connected with the source of the initialization transistor M2 in the semiconductor layer through a through-hole D1, with the source of the control transistor M3 through a through-hole D2, with the source of the anode reset transistor M6 through a through-hole D3, and with the first power source signal line PVDD1 in the second metal layer through the two connection holes A; the data signal line DATA is connected with the source of the switch transistor M1 through a through-hole D4; the connection line LINE is connected with the second terminal d2 of the storage capacitor C through a through-hole D5, and with the drain of the initialization transistor M2, and the source of the compensation transistor M4 through a through-hole D6.

Preferably in a specific implementation, in the organic electroluminescent display panel above according to the embodiment of the disclosure, all of the transistors as referred to in the organic electroluminescent display panel above according to the embodiment of the disclosure may be designed as N-type transistors, or all the transistors may be designed as P-type transistors, thus simplifying a process flow of fabricating the organic electroluminescent display panel.

In a specific implementation, in the organic electroluminescent display panel above according to the embodiment of the disclosure, the N-type transistors are turned on at a high potential, and turned off at a low potential; and the P-type transistors are turned off at a high potential, and turned on at a low potential.

It shall be noted that in the organic electroluminescent display panel above according to the embodiment of the disclosure, the respective transistors may be Thin Film Transistors (TFTs) or Metal Oxide Semiconductor Field Effect Transistors (MOSFET), although the embodiment of the disclosure will not be limited thereto. In a specific implementation, the sources and the drains of these transistors may be replaced with each other instead of being distinguished from each other. The specific embodiments have been and will be described with the transistors being thin film transistors.

Figure 8A:
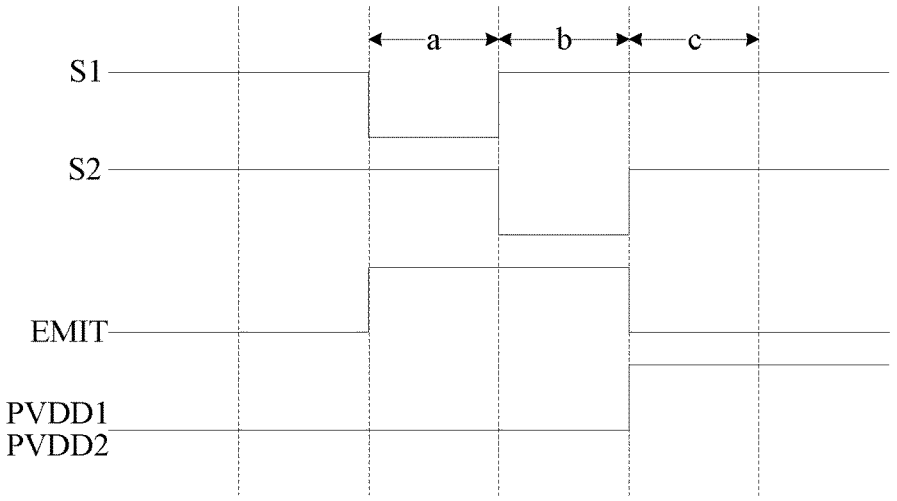
FIG. 8A and FIG. 8B are timing diagrams corresponding to organic electroluminescent display panels according to embodiments of the disclosure respectively.

An operating process of a pixel circuit in the organic electroluminescent display panel above according to the embodiment of the disclosure will be described below with reference to the circuit timing diagram illustrated in FIG. 8A taking the structure of the organic electroluminescent display panel illustrated in FIG. 5A as an example. In the following description, 1 represents a high potential, and 0 represents a low potential. It shall be noted that 1 and 0 are logic potential, where they are merely intended to better set forth the specific operating process according to the embodiment of the disclosure, but not to suggest the voltage applied to the gates of the respective transistors in a specific implementation. Specifically, generally three stages including the initialization stage a, the data writing stage b, and the light emitting stage c in the input-output timing diagram as illustrated in FIG. 5A will be described.

In the initialization stage a, EMIT=1, S1=0, S2=1, and PVDD1=PVDD2=0.

With S1=0, the initialization transistor M2 and the anode resetting transistor M6 are turned on to provide the gate of the drive transistor DTFT, and the organic light-emitting diode OLED with the low potential of the second power source signal line PVDD2 to thereby initialize and reset the drive transistor DTFT and the organic light-emitting diode OLED. With EMIT=1, the control transistor M3 and the light emitting control transistor M5 are turned off. With S2=1, the switch transistor M1 and the compensation transistor M4 are turned off.

In the data writing stage b, EMIT=1, S1=1, S2=0, and PVDD1=PVDD2=0.

With S1=1, the initialization transistor M2 and the anode resetting transistor M6 are turned off. With EMIT=1, the control transistor M3 and the light emitting control transistor M5 are turned off. With S2=0, the switch transistor M1 is turned on to provide the source of the drive transistor DTFT with the data signal of the data signal line DATA, and the compensation transistor M4 is turned on to make the gate and drain of the drive transistor DTFT turned on to thereby change the potential thereof to be VDATA−|Vth|.

In the light emitting stage c, EMIT=0, S1=1, S2=1, and PVDD1=PVDD2=1.

With S1=1, the initialization transistor M2 and the anode resetting transistor M6 are turned off. With S2=1, the switch transistor M1 and the compensation transistor M4 are turned off. With EMIT=1, the control transistor M3 is turned on to provide the source of the drive transistor with the high potential of the second power source signal line PVDD2, where Vsg of the drive transistor is Vsg=PVDD−VDATA+|Vth|, and I of the drive transistor is $I=K(Vsg-|Vth|)^2=K(PVDD-VDATA)^2$. The light emitting control transistor M5 is turned on to enable the driving current of the drive transistor DTFT to drive the organic light-emitting diode OLED to emit light.

As can be apparent from the description above of the timing of the pixel circuit, in the organic electroluminescent display panel above according to the embodiment of the disclosure, the initialization transistor M2 and the control transistor M3 are connected through the second power source signal line PVDD2, and if the initialization transistor M2 is turned on by the first scan signal line S1, and if the control transistor M3 is turned on by the light emitting control line EMIT, then different electrical signal will be loaded on the second power source signal line PVDD2 to thereby reset the gate of the drive transistor DTFT in the initialization stage when the initialization transistor M2 is turned on, and to load a high potential to the source of the drive transistor DTFT for light emission and displaying, in the light emitting stage c when the control transistor M3 is turned on.

Figure 8B:
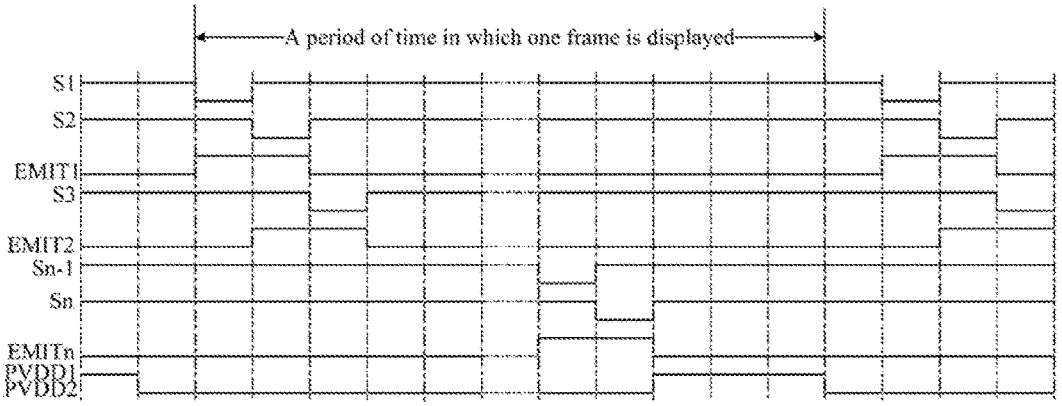

Furthermore if the organic electroluminescent display panel above according to the embodiment of the disclosure is applied to a virtual reality display device, then in order to display throughout the panel, that is, to enable all the organic light emitting diodes in the organic electroluminescent display panel to emit light and display concurrently, the respective rows of pixel circuits will be initialized and reset, and data will be written into them so that they emit light and display concurrently. Specifically as illustrated in the timing diagram of FIG. 8B, after low potentials are loaded on the respective signal lines S1, S2, S3, . . . , Sn−1, Sn; and the pixel circuits are initialized, and data is written into them, low potentials are loaded on the respective light emitting control lines EMIT1, EMIT2, . . . , EMITn so that the respective rows of pixel circuits enter the light emitting stage, but the second power source signal line PVDD2 will not be changed from a low potential to a high potential for light emission and displaying throughout the panel until all the pixel circuits are initialized, data are written into them, and they enter the light emission stage.

In order to display in a VR mode, the global display mode is a required display mode, and in the existing global display mode, typically the PVDD is pulled down, and then pulled up after all the data is written; or the PVEE is pulled up, and then pulled down after all the data is written; and as illustrated above, the PVDD is pulled down to the potential to initialize and reset the pixels, and then pulled up for the global display mode after the data is written normally into all the pixels, thus reducing the number of VREF wires to be routed, and also displaying normally.

Figure 9:
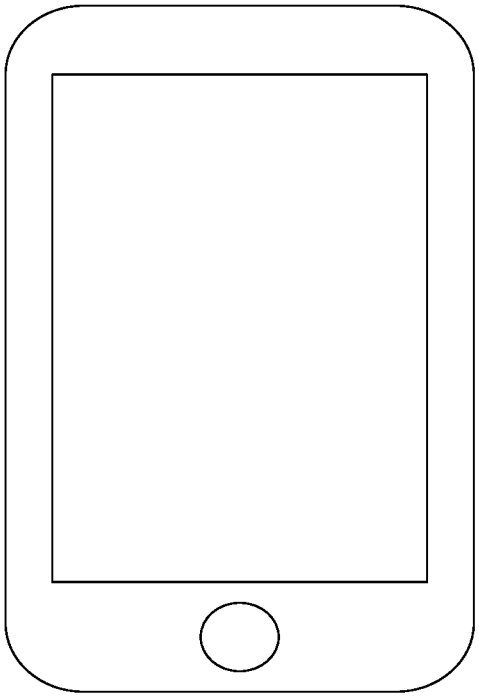
FIG. 9 is a schematic structural diagram of a display device according to an embodiment of the disclosure.

Based upon the same inventive idea, an embodiment of the disclosure further provides a display device as illustrated in FIG. 9 including the organic electroluminescent display panel above according to any one of the embodiments of the disclosure. The display device can be a mobile phone, a tablet computer, a TV set, a display, a notebook computer, a digital photo frame, a navigator, or any other product or component capable of displaying. All the other components indispensable to the display device will readily occur to those ordinarily skilled in the art, so a repeated description thereof will be omitted here. Reference can be made to the embodiments above of the organic electroluminescent display panel for an implementation of the display device, so a repeated description thereof will be omitted here.

Preferably the display device above according to the embodiment of the disclosure can be a virtual reality display device.

In the organic electroluminescent display panel and the display device above according to the embodiments of the disclosure, the initialization transistor and the control transistor are connected by the second power source signal line, and if the initialization transistor are switched by the first scan signal line, and if the control transistor are turned on by the light emitting control line, then different electrical signals will be loaded on the second power source signal line to reset the gate of the drive transistor in the initialization stage when the initialization transistor is turned on, and to load the power source voltage to the source of the drive transistor for light emission and displaying, in the light emitting stage when the control transistor is turned on, so that the existing two reset signal lines can be dispensed with to thereby simplify a complicated circuit arrangement pattern in the organic electroluminescent display panel so as to facilitate displaying at a high resolution. Furthermore the second power source signal line is arranged parallel to the data signal line, so that a line arrangement space perpendicular to the data signal line can be spared to arrange therein the first power source signal line across the second power source signal line and the data signal line, and the first terminal of the storage capacitor to thereby facilitate a compact circuit arrangement pattern design so as to facilitate displaying at a high resolution, thus facilitating a high PPI required for a virtual reality display. Furthermore the first power source signal line and the second power source signal line can be connected through the connection holes, and the connection holes can be arranged in the area where the storage capacitor is located, thus reducing a contact resistance.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

What is claimed is:

1. An organic electroluminescent display panel, comprising:

a first scan signal line, a second scan signal line, a light emitting control line, and a first power source signal line, all of which are arranged in parallel;

a data signal line and a second power source signal line, which are arranged in parallel and across the first scan signal line, the second scan signal line, the light emitting control line, and the first power source signal line;

a switch transistor with a gate connected with the second scan signal line, and a source connected with the data signal line;

a drive transistor with a source connected with a drain of the switch transistor;

an organic light emitting diode connected with a drain of the drive transistor;

an initialization transistor with a gate connected with the first scan signal line, a source connected with the second power source signal line, and a drain connected with a gate of the drive transistor;

a control transistor with a gate connected with the light emitting control line, a source connected with the second power source signal line, and a drain connected with the source of the drive transistor; and a storage capacitor with a first terminal connected with the first power source signal line, and a second terminal connected with the gate of the drive transistor;

wherein in a period of time of one frame, the second power source signal line are loaded with different electrical signals when the initialization transistor and the control transistor are turned on;

wherein the first scan signal line, the second scan signal line, the light emitting control line, and the second terminal of the storage capacitor are arranged at a same first metal layer;

wherein the first power source signal line and the first terminal of the storage capacitor are arranged at a second metal layer; and wherein the second metal layer is disposed on the first metal layer.

2. The organic electroluminescent display panel according to claim 1, wherein the initialization transistor is structured with dual gate.

3. The organic electroluminescent display panel according to claim 1, wherein the organic electroluminescent display panel further comprises a compensation transistor with a gate connected with the second scan signal line, a source connected with the gate of the drive transistor, and a drain connected with the drain of the drive transistor.

4. The organic electroluminescent display panel according to claim 3, wherein the compensation transistor is structured with dual gate.

5. The organic electroluminescent display panel according to claim 1, wherein the organic electroluminescent display panel further comprises light emitting control transistor with a gate connected with the light emitting control line, a source connected with the drain of the drive transistor, and a drain connected with the organic light emitting diode.

6. The organic electroluminescent display panel according to claim 1, wherein the organic electroluminescent display panel further comprises an anode reset transistor with a gate connected with the first scan signal line, a source connected with the second power source signal line, and a drain connected with the organic light emitting diode.

7. The organic electroluminescent display panel according to claim 1, wherein the first power source signal line and the second power source signal line are connected through connection holes.

8. The organic electroluminescent display panel according to claim 7, wherein the connection holes are arranged in an area where the storage capacitor is located.

9. The organic electroluminescent display panel according to claim 7, wherein the number of connection holes is two.

10. The organic electroluminescent display panel according to claim 1, wherein the data signal line and the second power source signal line are arranged at a third metal layer; and wherein the first metal layer, the second metal layer, and the third metal layer are stacked on each other with the first metal layer at a bottom.

11. The organic electroluminescent display panel according to claim 10, wherein channel areas of the respective transistors are arranged at a semiconductor layer, and the semiconductor layer is located below the first metal layer.

12. A display device, comprising an organic electroluminescent display panel, wherein the organic electroluminescent display panel comprises:

a first scan signal line, a second scan signal line, a light emitting control line, and a first power source signal line, all of which are arranged in parallel;

a data signal line and a second power source signal line, which are arranged in parallel and across the first scan signal line, the second scan signal line, the light emitting control line, and the first power source signal line;

a switch transistor with a gate connected with the second scan signal line, and a source connected with the data signal line;

a drive transistor with a source connected with a drain of the switch transistor;

an organic light emitting diode connected with a drain of the drive transistor;

an initialization transistor with a gate connected with the first scan signal line, a source connected with the second power source signal line, and a drain connected with a gate of the drive transistor;

a control transistor with a gate connected with the light emitting control line, a source connected with the second power source signal line, and a drain connected with the source of the drive transistor; and a storage capacitor with a first terminal connected with the first power source signal line, and a second terminal connected with the gate of the drive transistor;

wherein in a period of time of one frame, the second power source signal line are loaded with different electrical signals when the initialization transistor and the control transistor are turned on;

wherein the first scan signal line, the second scan signal line, the light emitting control line, and the second terminal of the storage capacitor are arranged at a same first metal layer; wherein the first power source signal line and the first terminal of the storage capacitor are arranged at a second metal layer; and wherein the second metal layer is disposed on the first metal layer.

13. The display device according to claim 12, wherein the display device is a virtual reality display device.

* * * * *